US008764181B2

(12) United States Patent
Suzuki

(10) Patent No.: US 8,764,181 B2
(45) Date of Patent: Jul. 1, 2014

(54) INK SUPPLY DEVICE AND IMAGE FORMING APPARATUS

(75) Inventor: Toshihiko Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/541,344

(22) Filed: Jul. 3, 2012

(65) Prior Publication Data

US 2013/0208058 A1 Aug. 15, 2013

(30) Foreign Application Priority Data

Feb. 13, 2012 (JP) ..... 2012-028928

(51) Int. Cl.
*B41J 2/01* (2006.01)
*B41F 31/00* (2006.01)

(52) U.S. Cl.
USPC ..... 347/103; 101/350.5

(58) Field of Classification Search
USPC ..... 347/85, 93, 103; 399/237, 248, 249; 101/350.5
See application file for complete search history.

(56) References Cited

U.S. PATENT DOCUMENTS 4,497,250 A * 2/1985 Dressler ..... 101/350.5
4,690,055 A * 9/1987 Fadner et al. ..... 101/451
4,757,782 A * 7/1988 Pullinen ..... 118/411
4,864,925 A * 9/1989 Van Kanegan et al. ..... 101/141
4,929,355 A * 5/1990 Ragnegård et al. ..... 210/784
4,981,726 A * 1/1991 Rantanen et al. ..... 427/356
5,079,044 A * 1/1992 Schumacher et al. ..... 427/207.1
5,120,630 A * 6/1992 Wadlo et al. ..... 430/103
5,280,750 A * 1/1994 Yoshida et al. ..... 101/363
5,357,864 A * 10/1994 Ohta et al. ..... 101/483
5,463,453 A * 10/1995 Kurotori et al. ..... 399/249
5,561,264 A * 10/1996 Iino et al. ..... 399/240
5,633,045 A * 5/1997 Smith et al. ..... 427/428.17
5,689,779 A * 11/1997 Miyamoto et al. ..... 399/237
5,724,629 A * 3/1998 Iino et al. ..... 399/57
5,793,400 A * 8/1998 Mukoyama et al. ..... 347/140
6,241,344 B1 * 6/2001 Machida ..... 347/66
6,853,827 B2 * 2/2005 Song et al. ..... 399/237
7,506,975 B2 * 3/2009 Cellura et al. ..... 347/103
7,520,934 B2 * 4/2009 Nojo et al. ..... 118/212
8,282,201 B2 * 10/2012 Kessler ..... 347/93
2002/0148580 A1 * 10/2002 Sugihara et al. ..... 162/135
2004/0135860 A1 * 7/2004 Williams ..... 347/96
2004/0146317 A1 * 7/2004 Park ..... 399/237
2006/0093404 A1 * 5/2006 Chou et al. ..... 399/237
2006/0115762 A1 * 6/2006 Katano et al. ..... 430/124
2007/0147862 A1 * 6/2007 Nakamura et al. ..... 399/45
2009/0003903 A1 * 1/2009 Katano et al. ..... 399/340
2010/0060688 A1 * 3/2010 Hirato ..... 347/14

* cited by examiner

*Primary Examiner* — Matthew Luu
*Assistant Examiner* — Patrick King
(74) *Attorney, Agent, or Firm* — Sughrue Mion, PLLC

(57) ABSTRACT

An ink supply device includes a reservoir; an ink carrying rotary member; a supply rotary member that rotates and supplies ink to the ink carrying rotary member while a part thereof is immersed in the ink in the reservoir; a regulation member that faces an outer peripheral surface of the supply rotary member, the regulation member regulating an amount of ink on the outer peripheral surface of the supply rotary member at a position outside of the reservoir; and a blocking member that extends from below to above a liquid surface of the ink in the reservoir at a position between a landing position and the supply rotary member, the landing position being a position at which ink that has been scraped off by the regulation member lands on the liquid surface, the blocking member blocking movement of the ink from the landing position to the supply rotary member.

4 Claims, 7 Drawing Sheets

INK SUPPLY DEVICE AND IMAGE FORMING APPARATUS

CROSS-REFERENCE TO RELATED APPLICATIONS

This application is based on and claims priority under 35 USC 119 from Japanese Patent Application No. 2012-028928 filed Feb. 13, 2012.

BACKGROUND

Technical Field

The present invention relates to an ink supply device and an image forming apparatus.

SUMMARY

According to an aspect of the invention, an ink supply device includes a reservoir that stores ink; an ink carrying rotary member that carries ink on an outer peripheral surface thereof; a supply rotary member that is rotatable about a rotation axis that is parallel to a rotation axis of the ink carrying rotary member, the supply rotary member rotating and supplying the ink to the outer peripheral surface of the ink carrying rotary member while a part of the supply rotary member is immersed in the ink in the reservoir; a regulation member that faces an outer peripheral surface of the supply rotary member, the regulation member regulating an amount of ink on the outer peripheral surface of the supply rotary member at a position outside of the reservoir; and a blocking member that extends from below to above a liquid surface of the ink in the reservoir at a position between a landing position and the supply rotary member, the landing position being a position at which ink that has been scraped off by the regulation member lands on the liquid surface, the blocking member blocking movement of the ink in the reservoir from the landing position to the supply rotary member.

BRIEF DESCRIPTION OF THE DRAWINGS

Exemplary embodiments of the present invention will be described in detail based on the following figures, wherein.

DETAILED DESCRIPTION

First Exemplary Embodiment

Examples of a developing device, which is an example of an ink supply device, and an image forming apparatus according to a first exemplary embodiment of the present invention will be described.

Overall Structure

Figure 1:
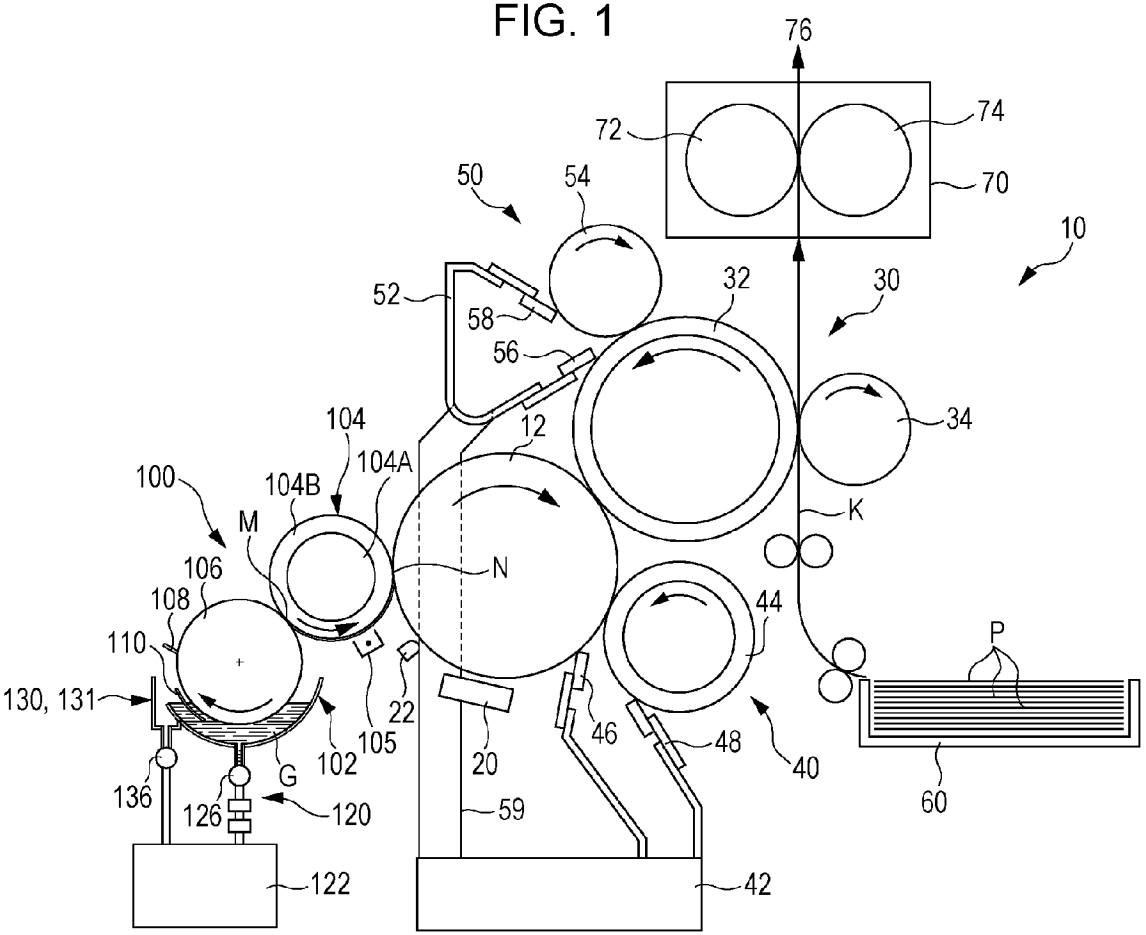
FIG. 1 is a schematic view illustrating an image forming apparatus according to a first exemplary embodiment of the present invention.

FIG. 1 illustrates an image forming apparatus 10, which is an example of the first exemplary embodiment. The image forming apparatus 10 includes a photoconductor 12, which is an example of an image carrier that is cylindrical and rotatable and that carries a latent image on the outer peripheral surface thereof. A charger 20, an exposure device 22, a developing device 100, a transfer device 30, and a photoconductor cleaner 40 are arranged around the photoconductor 12. The transfer device 30 is an example of a transfer unit. The developing device 100 is an example of an ink supply device.

The charger 20 is disposed below the photoconductor 12 so as to face the outer peripheral surface of the photoconductor 12 with a distance therebetween. The charger 20 is, for example, a scorotron charger. The charger 20 charges the surface (outer peripheral surface) of the photoconductor 12 by performing corona discharge.

The exposure device 22 is disposed downstream of the charger 20 in the rotation direction of the photoconductor 12. The exposure device 22 is, for example, an LED exposure device. The exposure device 22 exposes the outer peripheral surface of the photoconductor 12, which has been charged by the charger 20, to light on the basis of image information, thereby forming a latent image on the outer peripheral surface of the photoconductor 12. The exposure device 22 may be a device other than an LED exposure device. For example, the exposure device 22 may be a device that performs exposure by emitting a laser beam.

The developing device 100 includes a development roller 104, which is an example of an ink carrying rotary member, and a supply roller 106, which is an example of a supply rotary member. The supply roller 106 supplies a liquid developer G, which is an example of ink, to an outer peripheral surface of the development roller 104. The developing device 100 is disposed downstream of the exposure device 22 in the rotation direction of the photoconductor 12. The developing device 100 develops the latent image (forms a visible image) on the photoconductor 12 using the liquid developer G composed of a carrier liquid and a toner (toner particles) dispersed in the carrier liquid, thereby forming a toner image (developer image) on the outer peripheral surface of the photoconductor 12. The details of the developing device 100 and the liquid developer G will be described below.

The transfer device 30 is disposed downstream of the developing device 100 in the rotation direction of the photoconductor 12. The transfer device 30, which is a device using an intermediate transfer method, includes an intermediate transfer member 32, an intermediate transfer member cleaner 50, and a transfer roller 34. The intermediate transfer member 32 is a cylindrical member to which a toner image formed on the outer peripheral surface of the photoconductor 12 is transferred. The transfer roller 34 transfers the toner image, which has been transferred to the outer peripheral surface of the intermediate transfer member 32, to a recording sheet P, which is an example of a recording medium. That is, the transfer device 30 transfers the toner image via the intermediate transfer member 32 to the recording sheet P using the transfer roller 34.

The transfer device 30 may have a structure that is different from the structure described above. For example, the intermediate transfer member may have a belt-like shape. The transfer device 30 may be a device using a direct-transfer method, which does not include an intermediate transfer member and an intermediate transfer member cleaner and directly transfers a toner image from the photoconductor 12 to the recording sheet P using the transfer roller 34.

The photoconductor cleaner 40 includes a first waste toner tank 42, a cleaning roller 44, and cleaning blades 46 and 48. The cleaning roller 44 is in contact with the outer peripheral surface of the photoconductor 12 at a position upstream of the charger 20 in the rotation direction of the photoconductor 12. The cleaning blades 46 and 48 are made from a polyurethane rubber. The cleaning blades 46 and 48, which are respectively in contact with the photoconductor 12 and the cleaning roller 44, remove the liquid developer G that remains on the outer peripheral surface of the photoconductor 12 after transfer of a toner image has been finished. The removed liquid developer G is recovered into the first waste toner tank 42.

The intermediate transfer member cleaner 50 includes a second waste toner tank 52, a cleaning roller 54 that is in contact with the outer peripheral surface of the intermediate transfer member 32, and cleaning blades 56 and 58 made from a polyurethane rubber. The cleaning blades 56 and 58, which are respectively in contact with the intermediate transfer member 32 and the cleaning roller 54, remove the liquid developer G. The removed liquid developer G is recovered into the second waste toner tank 52. The liquid developer G that has been recovered into the second waste toner tank 52 flows through a pipe 59 to the first waste toner tank 42.

The cleaning roller 44 for the photoconductor 12 and the cleaning roller 54 for the intermediate transfer member each include a metal core shaft made from a stainless steel and a rubber coating formed on the surface of the metal core shaft. The rubber coating may be made from an oil-resistant rubber, such as NBR (acrylonitrile-butadiene rubber) or ECO (epichlorohydrin rubber). The thickness of the rubber coating is, for example, in the range of 5 to 20 mm. The entirety of the cleaning roller for the intermediate transfer member may be made from a metal such as aluminum, iron, or a stainless steel. In this case, the smoothness and the wear resistance of the surface of the cleaning roller may be increased by plating the surface with of the roller.

The image forming apparatus 10 includes a sheet container 60 in which recording sheets P are contained, and the recording sheets P are transported one by one along a transport path K. Moreover, the image forming apparatus 10 includes a fixing unit 70 that fixes a toner image on the recording sheet P, to which the toner image has been transferred. The fixing unit 70 fixes the toner image using, for example, a contact thermal fixing method, which uses a fixing roller 72 and a pressing roller 74. Alternatively, the fixing method may be a contact thermal fixing method using a fixing roller or a fixing belt or may be a non-contact thermal fixing method using an oven or a flash lamp.

Image Forming Process

Next, the process of forming an image with the image forming apparatus 10 will be described.

Each of the rollers is rotated by a driving device (not shown) or is rotated by another roller in the directions indicated by arrows.

As illustrated in FIG. 1, the charger 20 charges the surface of the photoconductor 12 and the exposure device 22 forms a latent image on the basis of image information. The developing device 100 develops the latent image on the surface of the photoconductor 12, thereby forming a toner image on the surface of the photoconductor 12.

Subsequently, a bias voltage is applied to the core metal shaft (not shown) of the intermediate transfer member 32, and the toner image formed on the photoconductor 12 is first-transferred to the outer peripheral surface of the intermediate transfer member 32 due to the potential difference between the intermediate transfer member 32 and the photoconductor 12, which is grounded. The toner image, which has been first-transferred, is second-transferred to the recording sheet P due to the potential difference between the bias voltage applied to the intermediate transfer member 32 and the bias voltage applied to the transfer roller 34.

Subsequently, the recording sheet P, to which the toner image has been transferred, is transported to the fixing unit 70, which fixes the toner image onto the recording sheet P. The recording sheet P, to which the toner image has been fixed, is output to an output unit 76 that is disposed at an the end of a transport path K in the image forming apparatus 10.

The photoconductor cleaner 40 removes the liquid developer G that was not first-transferred to the intermediate transfer member 32 and that remains on the photoconductor 12. The intermediate transfer member cleaner 50 removes the liquid developer G that was not second-transferred to the intermediate transfer member 32 and that remains on the intermediate transfer member 32.

Toner included in the remaining liquid developer G is removed by being attracted to the cleaning roller 44 for the photoconductor and the cleaning roller 54 for the intermediate transfer member, because bias voltages are applied to the core metal shafts of the cleaning rollers 44 and 54. After the toner included in the remaining liquid developer G has been removed, the cleaning roller 44 for the photoconductor and the cleaning roller 54 for the intermediate transfer member remove the carrier liquid.

Structure of Developing Device

Next, the developing device 100 will be described.

Figure 2:
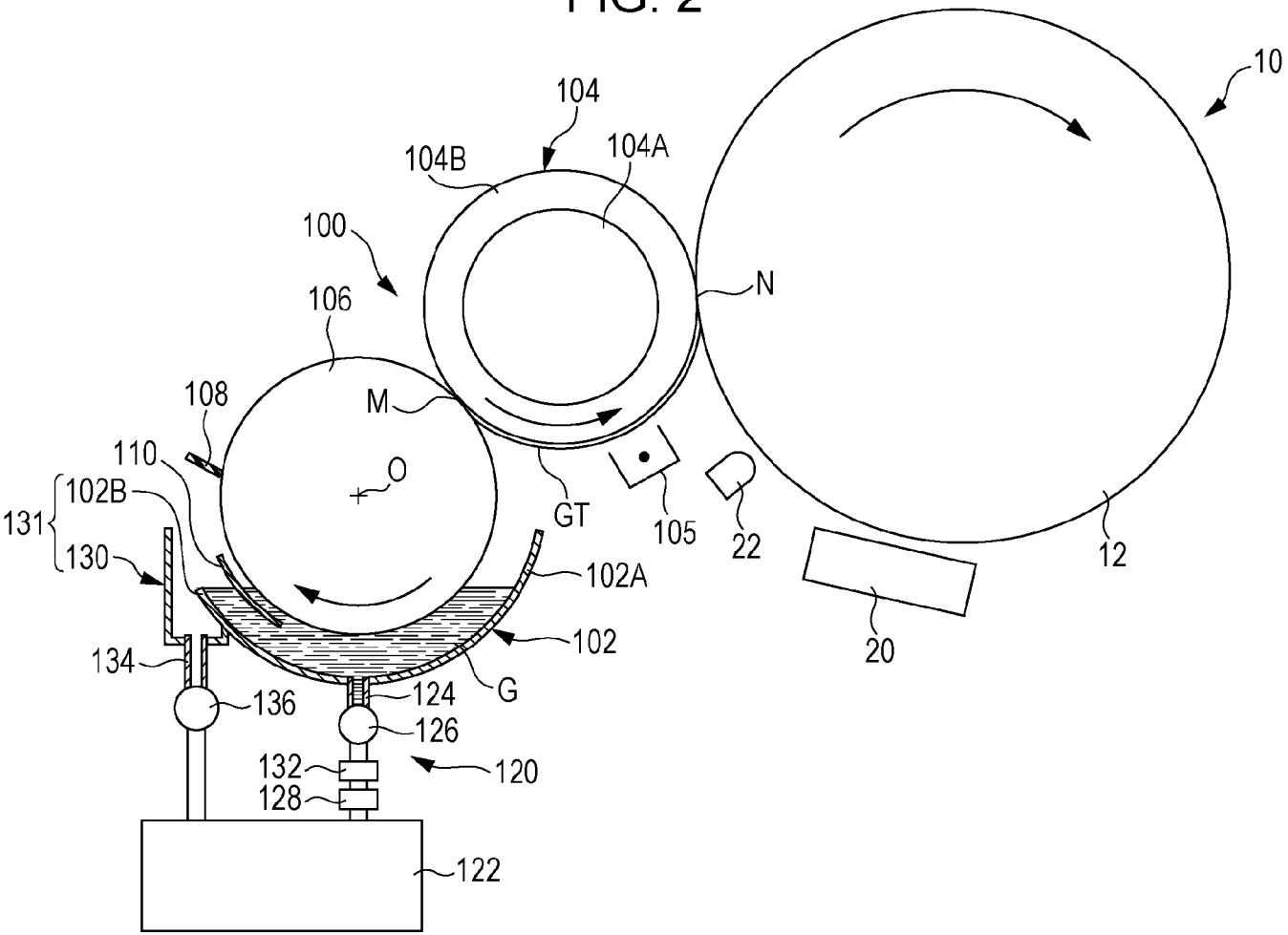
FIG. 2 is a schematic view illustrating a developing device according to the first exemplary embodiment of the present invention.

As illustrated in FIG. 2, the developing device 100 includes a reservoir 102, the development roller 104, the supply roller (anilox roller) 106, a regulation blade 108, and a blocking member 110. The reservoir 102 stores the liquid developer G. The development roller 104, which is an example of an ink carrying rotary member, carries the liquid developer G on the outer peripheral surface thereof. The supply roller 106, which is an example of a supply rotary member, supplies the liquid developer G to the outer peripheral surface of the development roller 104. The regulation blade 108, which is an example of a regulation member, regulates the amount of liquid developer on the outer peripheral surface of the supply roller 106. The blocking member 110 blocks movement of the liquid developer G from a landing position to the supply roller 106. Here, the landing position (described below in detail) is a position at which the liquid developer G that has been scraped off by the regulation blade 108 lands on the liquid surface of the liquid developer G.

The developing device 100 further includes a developer supply portion 120 and an overflow portion 131. The developer supply portion 120, which is an example of an ink supply unit, supplies the liquid developer G into the reservoir 102. The overflow portion 131, which is included in the reservoir 102, includes a second curved wall 102B that allows the liquid developer G to overflow. The overflow portion 131 includes a receiving portion 130 that receives the liquid developer G that has flowed over the second curved wall 102B.

The liquid developer G includes a carrier liquid and a toner (toner particles) dispersed in the carrier liquid. An insulating liquid such as a vegetable oil, a liquid paraffin, or a silicone oil is used as a carrier liquid. For example, the liquid developer G includes toner particles having an average particle diameter in the range of 0.5 to 5 μm, and the toner particles are dispersed in the carrier liquid with a concentration in the range of 15 to 35 wt %. The liquid developer G may further include a charge control agent or a dispersing agent. The higher the temperature of the liquid developer G (carrier liquid), the lower the viscosity of the liquid developer G, and vice versa.

The reservoir 102 is a container that extends in a longitudinal direction that is the same as the direction of the rotation axis (hereinafter, referred to as the axial direction) of the supply roller 106 and has a cross section intersecting the longitudinal direction having an arc shape that is open upward. When the reservoir 102 is seen in the longitudinal direction, a first curved wall 102A and the second curved wall 102B are located along the same arc and are integrated with each other.

The first curved wall 102A, which has an arc-shaped cross section, is disposed at a position below the rotation center O of the supply roller 106 (on the lower right side in FIG. 2) so as to face the outer peripheral surface of the supply roller 106. The first curved wall 102A is disposed such that the distance between the first curved wall 102A and the outer peripheral surface of the supply roller 106 is substantially uniform along the circumferential direction of the supply roller 106.

The second curved wall 102B, which has an arc-shaped cross section (extending toward the receiving portion 130), is disposed at a position below the rotation center O of the supply roller 106 (on the lower left side in FIG. 2) so as to face the outer peripheral surface of the supply roller 106. When the reservoir 102 is seen in the longitudinal direction, the upper end of the first curved wall 102A is higher than the upper end of the second curved wall 102B. The liquid developer G is stored in the reservoir 102.

Moreover, for example, a liquid surface detection sensor (not shown) that measures the amount of the liquid developer G remaining in the reservoir 102 is disposed in the reservoir 102. When the amount of the liquid developer G in the reservoir 102 decreases and becomes insufficient, the developer supply portion 120 supplies new liquid developer G to the reservoir 102. The amount of the liquid developer G in the reservoir 102 is determined to be insufficient if, for example, the liquid surface of the liquid developer G is below the lower end of the blocking member 110 described below. Alternatively, the liquid developer G may be constantly supplied to the reservoir 102 without using such a sensor for measuring the amount of remaining liquid developer G.

The development roller 104 includes a cylindrical core roller 104A and a semi-conductive elastic layer 104B formed on the core roller 104A. For example, the core roller 104A is made from a metal, and the semi-conductive elastic layer 104B has a volume resistivity in the range of $1\times10^5$ to $1\times10^{10}$ Ω·cm. A bias voltage is applied to the core roller 104A, which is made from a metal.

The supply roller 106 is in contact with the elastic layer 104B of the development roller 104 in a layer forming region M, and a developer layer GT of the liquid developer G is formed on the development roller 104 in the layer forming region M. Moreover, the photoconductor 12 is in contact with the elastic layer 104B of the development roller 104 in a developing nip region N, and the liquid developer G of the developer layer GT is transferred to the photoconductor 12 in the developing nip region N. Liquid developer (not shown) that was not transferred to the photoconductor 12 remains on a side of the development roller 104 downstream of the developing nip region N in the rotation direction of the development roller 104. At the layer forming region M, the supply roller 106 and the development roller 104 move (rotate) in the same direction. At the developing nip region N, the development roller 104 and the photoconductor 12 move (rotate) in the same direction.

A charger 105 is disposed at the periphery of the development roller 104 at a position between the layer forming region M and the developing nip region N (so as to face the outer peripheral surface of the development roller 104). The charger 105 charges a part of the surface of the developer layer GT between the layer forming region M and the developing nip region N. In other words, the charger 105 charges the developer layer GT at a position upstream of the photoconductor 12 in the rotation direction of the development roller 104. The charger 105 charges the developer layer GT with a polarity the same as that of the toner of the liquid developer G that forms the developer layer GT. The charger 105 is, for example, a corotron charger, which charges the developer layer GT by performing corona discharge.

The supply roller 106 is rotatable about an axis that extends in a direction the same as the axial direction of the development roller 104. A lower portion of the supply roller 106 is immersed in the liquid developer G in the reservoir 102, and the supply roller 106 is in contact with the development roller 104 at a part thereof that is not immersed in the liquid developer G. The supply roller 106 rotates while a portion (a lower portion) is immersed in the liquid developer G in the reservoir 102, and thereby the supply roller 106 carries the liquid developer G on the outer peripheral surface thereof and supplies the liquid developer G to the outer peripheral surface of the development roller 104.

Grooves in a diagonal pattern, for example, are formed in the outer peripheral surface of the supply roller 106. Besides the diagonal pattern, the pattern of the grooves in the surface of the supply roller 106 may be a pyramidal pattern, a grid pattern, a honeycomb pattern, or the like.

The regulation blade 108 is, for example, a plate-shaped member extending in a longitudinal direction that is the same as the axial direction of the supply roller 106. The regulation blade 108 is disposed so as to face the outer peripheral surface of the supply roller 106, and an end portion of the regulation blade 108 in the transversal direction is in contact with the outer peripheral surface of the supply roller 106 (on the upper left side with respect to the rotation center O in FIG. 2). Thus, the regulation blade 108 regulates the amount of the liquid developer G on the outer peripheral surface of the supply roller 106 at a position outside of the reservoir 102. As long as the regulation blade 108 is capable of regulating the amount of the liquid developer G that is carried by the supply roller 106, the regulation blade 108 may be disposed such that the end portion in the transversal direction faces the outer peripheral surface of the supply roller 106 with a gap therebetween.

Figure 3:
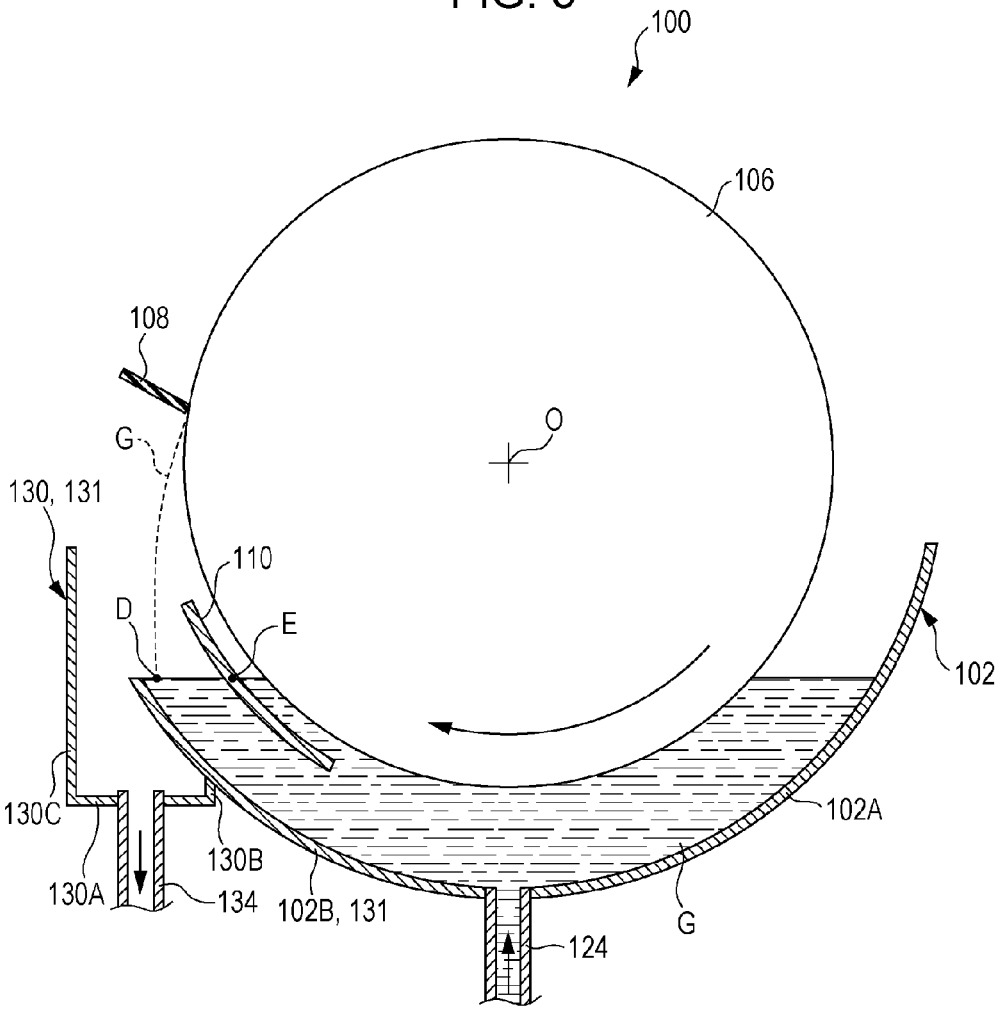
FIG. 3 a schematic view illustrating a region surrounding a supply roller of the developing device according to the first exemplary embodiment of the present invention.

As illustrated in FIG. 3, the blocking member 110 is, for example, a member that extends in the longitudinal direction, which is the same as the axial direction of the supply roller 106, and that has an arc-shaped cross section taken along a plane intersecting the longitudinal direction. Both end portions of the blocking member 110 in the longitudinal direction are located outside of both end portions of the supply roller 106 in the axial direction. In the cross-sectional view taken along a plane intersecting the longitudinal direction, the liquid developer G that has been scraped off by the regulation blade 108 lands onto the liquid surface of the liquid developer G in the reservoir 102 at a position D (hereinafter referred to as the landing position D). A part of the blocking member 110 is immersed in the liquid developer G such that the blocking member 110 extends from below to above the liquid surface of the liquid developer G at a position E that is between the position D and the supply roller 106. The blocking member 110 extends along the circumferential direction of the supply roller 106 such that the distance between the blocking member 110 and the outer peripheral surface of the supply roller 106 is substantially uniform.

The landing position D on the liquid surface of the liquid developer G in the reservoir 102 is determined, for example, as follows. An experiment is performed to obtain the positions at which the liquid developer G lands on the liquid surface of the liquid developer G when the liquid developer G falls (as illustrated by a broken line) from the distal end of the regulation blade 108 (an end adjacent to the supply roller 106) when the supply roller 106 rotates at a predetermined speed. The landing position D is determined as one of the obtained positions that is closest to the outer peripheral surface of the supply roller 106.

As illustrated in FIG. 2, the developer supply portion 120 includes a storage tank 122, a supply path 124, and a pump 126. The storage tank 122 stores the liquid developer G therein. The supply path 124 connects the storage tank 122 to the reservoir 102. The pump 126 is disposed in the supply path 124 and supplies the liquid developer G from the storage tank 122 through the supply path 124 to the reservoir 102. A degassing unit 128 and a toner concentration sensor 132 are disposed in the supply path 124 between the storage tank 122 and the pump 126. The degassing unit 128 removes bubbles from the liquid developer G. The toner concentration sensor 132 measures the concentration of toner (particles) in the liquid developer G.

For example, toner (particles) and a carrier liquid are supplied to the storage tank 122 from different supply units. The toner and the carrier liquid are agitated in the storage tank 122 to form the liquid developer G in the storage tank 122, and the liquid developer G is stored in the storage tank 122.

The supply path 124 includes, for example, a pipe. One end of the supply path 124 is connected to the storage tank 122 and the other end of the supply path 124 is connected to the deepest portion of the reservoir 102.

The pump 126, for example, is operated on the basis of information sent from the aforementioned liquid surface detection sensor (not shown) for measuring the height of the liquid surface of the liquid developer G stored in the reservoir 102. That is, the pump 126 starts operating when information indicating shortage of the liquid developer G in the reservoir 102 is input from the liquid surface detection sensor, and the pump 126 stops operating when such information is not input from the liquid surface detection sensor.

The degassing unit 128, for example, has two chambers, and while the liquid developer G flows through one of the chambers, bubbles are removed from the liquid developer G by depressurizing the other chamber. The degassing unit 128 is disposed upstream (on a side nearer to the storage tank 122) of the toner concentration sensor 132 in the flow direction of the liquid developer G.

The toner concentration sensor 132 includes, for example, a light-emitting element and a light-receiving element (not shown) and measures the concentration of toner on the basis of the amount of light that has been emitted by the light-emitting element and passed through the liquid developer G and that is received by the light-receiving element. That is, the higher the proportion of light that is blocked, the higher the toner concentration. If the toner concentration measured by the toner concentration sensor 132 is higher than a reference concentration, the carrier liquid is supplied to the storage tank 122. If the toner concentration measured by the toner concentration sensor 132 is lower than the reference concentration, the toner (partially including the carrier liquid) is supplied to the liquid developer G. Thus, the toner concentration in the liquid developer G is adjusted.

As illustrated in FIG. 3, the second curved wall 102B is located opposite the supply roller 106 with the landing position D of the liquid developer G falling from the regulation blade 108 therebetween. The receiving portion 130 is disposed outside of the second curved wall 102B. The receiving portion 130 extends in a longitudinal direction that is the same as the axial direction of the supply roller 106. The receiving portion 130 includes a bottom wall 130A, a side wall 130B, and a side wall 130C. In a cross-sectional view taken along a plane intersecting the longitudinal direction, the bottom wall 130A has a plate-like shape, the side wall 130B stands upright at one end of the bottom wall 130A (on a side near the second curved wall 102B), and the side wall 130C stands at the other end of the bottom wall 130A (on a side opposite to the side on which the second curved wall 102B is located).

The position of the bottom wall 130A in the vertical direction is higher than that of a position at which the supply path 124 is connected to the reservoir 102 and lower than that of the upper end of the second curved wall 102B. The upper end of the side wall 130B is attached to the lower surface of the second curved wall 102B. The side wall 130C extends vertically upward to a position that is higher than the upper end of the second curved wall 102B.

As illustrated in FIG. 2, the developing device 100 further includes a recovery path 134 and a pump 136. The recovery path 134 connects the storage tank 122 to the receiving portion 130 (bottom wall 130A). The pump 136 is disposed in the recovery path 134 and recovers the liquid developer G from the receiving portion 130 to the storage tank 122. Alternatively, instead of using the pump 136, the developing device 100 may be configured such that the liquid developer G flows to the storage tank 122 on its own weight.

The recovery path 134 includes, for example, a pipe having one end connected to the storage tank 122 and the other end connected to the bottom wall 130A of the receiving portion 130. The pump 136 is operated, for example, at set times.

Operation

Next, the operation of the first exemplary embodiment will be described.

As illustrated in FIG. 2, a controller (not shown) of the image forming apparatus 10 activates the pump 126, and the liquid developer G is supplied from the storage tank 122 to the reservoir 102. After the degassing unit 128 has degassed the liquid developer G, the toner concentration sensor 132 measures the toner concentration of the liquid developer G, and the liquid developer G is supplied into the reservoir 102. As a result, the height of the liquid surface of the liquid developer G in the reservoir 102 reaches the height of the upper end of the second curved wall 102B.

Figure 4:
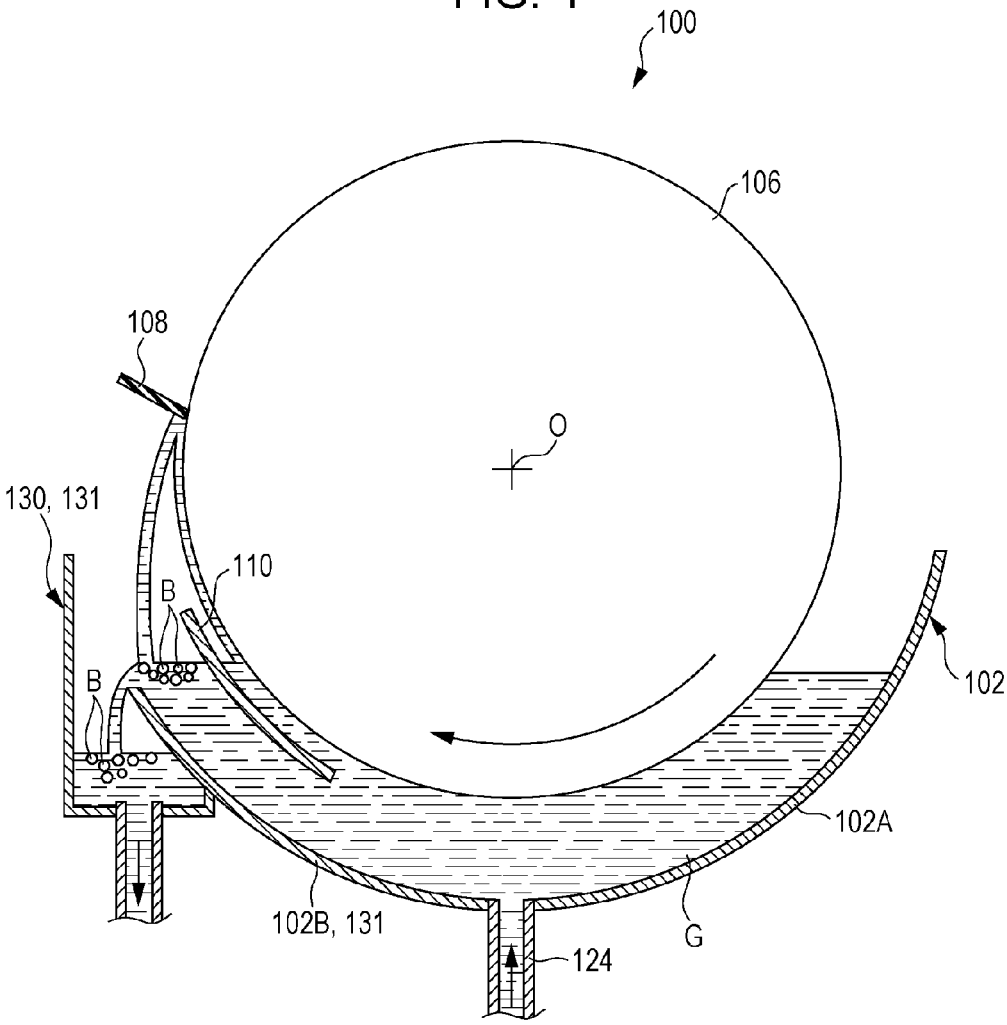
FIG. 4 is a schematic view illustrating a region surrounding the supply roller of the developing device according to the first exemplary embodiment of the present invention when bubbles are generated in a liquid developer near the supply roller.

Subsequently, as illustrated in FIG. 4, the supply roller 106 starts rotating when an image forming operation starts, and the liquid developer G is carried on the outer peripheral surface of the supply roller 106. A part of the liquid developer G carried on the outer peripheral surface of the supply roller 106 passes the regulation blade 108 and is supplied to the development roller 104, and the remaining part of the liquid developer G is scraped off the outer peripheral surface by the regulation blade 108 toward the reservoir 102.

Figure 5:
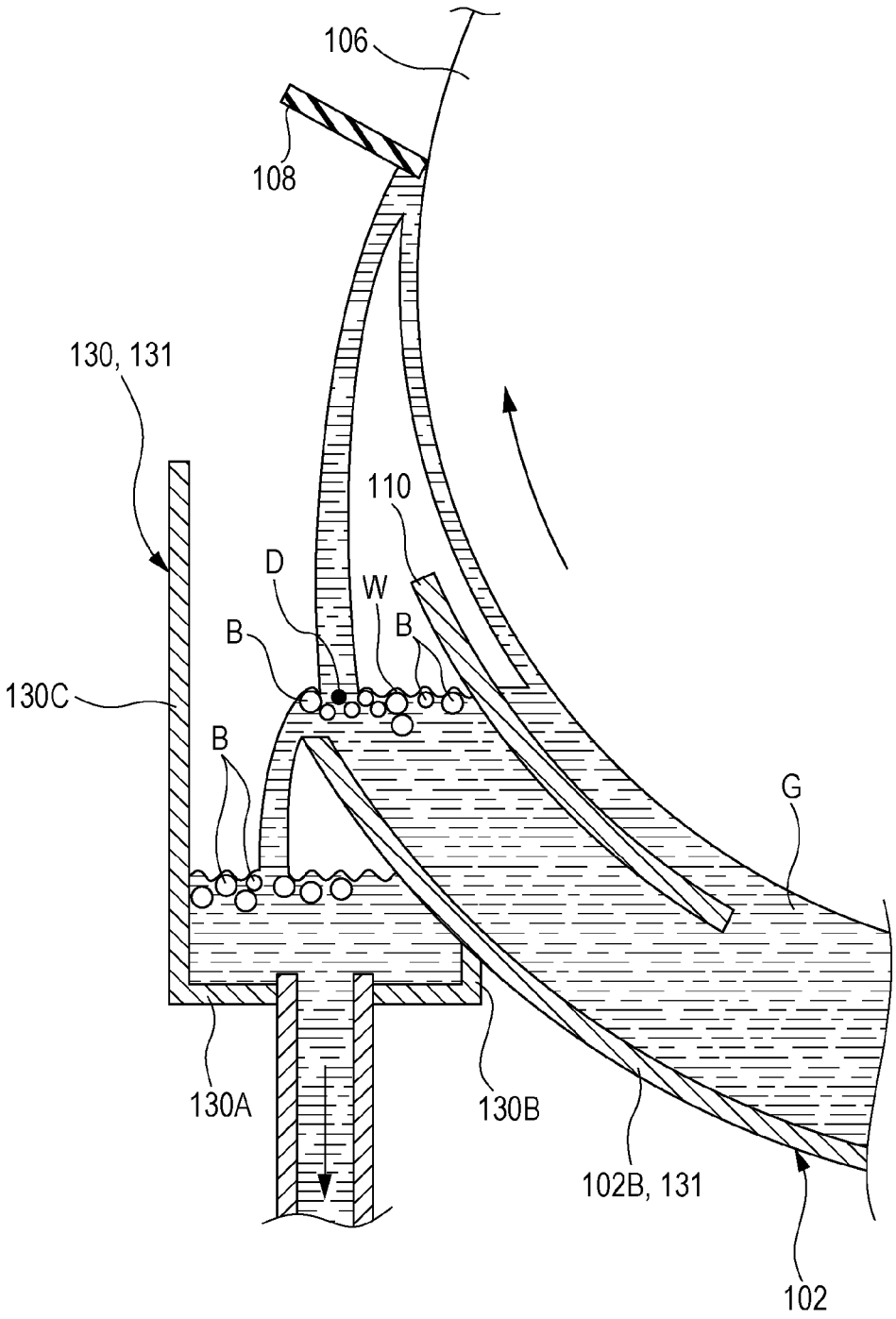
FIG. 5 is a schematic view illustrating a region surrounding the supply roller of the developing device according to the first exemplary embodiment of the present invention when bubbles and waves are generated in the liquid developer near the supply roller.

Subsequently, as illustrated in FIG. 5, as the liquid developer G is scraped off by the regulation blade 108 and lands on the liquid developer G at the landing position D, bubbles B and ripples W (waves) of the liquid surface are generated at the landing position D in the reservoir 102.

Here, a developing device that does not include the blocking member 110 is examined as a comparative example. In this case, the liquid developer G is lifted as the supply roller 106 rotates, and thereby the liquid developer G is drawn toward the supply roller 106. Accordingly, the liquid developer G flows from the landing position D toward the outer peripheral surface of the supply roller 106. As a result, the bubbles B, which have been generated at the landing position D, are transported together with the liquid developer G on the outer peripheral surface of the supply roller 106. Due to the presence of the ripples W of the liquid surface, which have been generated at the landing position D, the layer of the liquid developer G on the outer peripheral surface of the supply roller 106 may become nonuniform.

In contrast, with the developing device 100 according to the present exemplary embodiment, the blocking member 110 blocks the movement of the bubbles B and the ripples W of the liquid surface, which have been generated at the landing position D, before the bubbles B and the ripples W reach the supply roller 106. Thus, the amount of bubbles B included in the developer G on the outer peripheral surface of the supply roller 106 is reduced and the ripples W of the liquid surface are suppressed. As a result, generation of nonuniformity in the layer of the liquid developer G on the outer peripheral surface of the supply roller 106 is suppressed, and therefore nonuniformity in a developer image formed on the outer peripheral surface of the photoconductor (see FIG. 1) is reduced.

With the developing device 100, the liquid surface of the liquid developer G rises when new liquid developer G is supplied by the developer supply portion 120 (see FIG. 2). Then, a surface portion of the liquid developer G at the landing position D and in the vicinity of landing position D flows over the upper end of the second curved wall 102B to the receiving portion 130. Because the bubbles B generated at the landing position D are present in the surface portion, the bubbles B are removed together with the liquid developer G that overflows to the receiving portion 130. Thus, the amount of bubbles in the surface portion of the liquid developer G adjacent to a side of the supply roller 106 at which the supply roller 106 moves from below to above the liquid surface is reduced.

With the developing device 100, new liquid developer G is supplied from the deepest portion of the reservoir 102, so that the new developer is not directly supplied to a position near the liquid surface of the liquid developer G. Thus, the amount of new liquid developer G (including only a small amount of bubbles, if any) that overflows to the receiving portion 130 before being supplied to the supply roller 106 is reduced.

Subsequently, as illustrated in FIG. 2, the liquid developer G that has overflowed to the receiving portion 130 is recovered to the storage tank 122 as the pump 136 operates.

Second Exemplary Embodiment

Next, examples of a developing device, which is an example of an ink supply device, and an example of an image forming apparatus according to a second exemplary embodiment of the present invention will be described. Members and portions the same as those of the first exemplary embodiment will be denoted by the same numerals and description thereof will be omitted.

Figure 6:
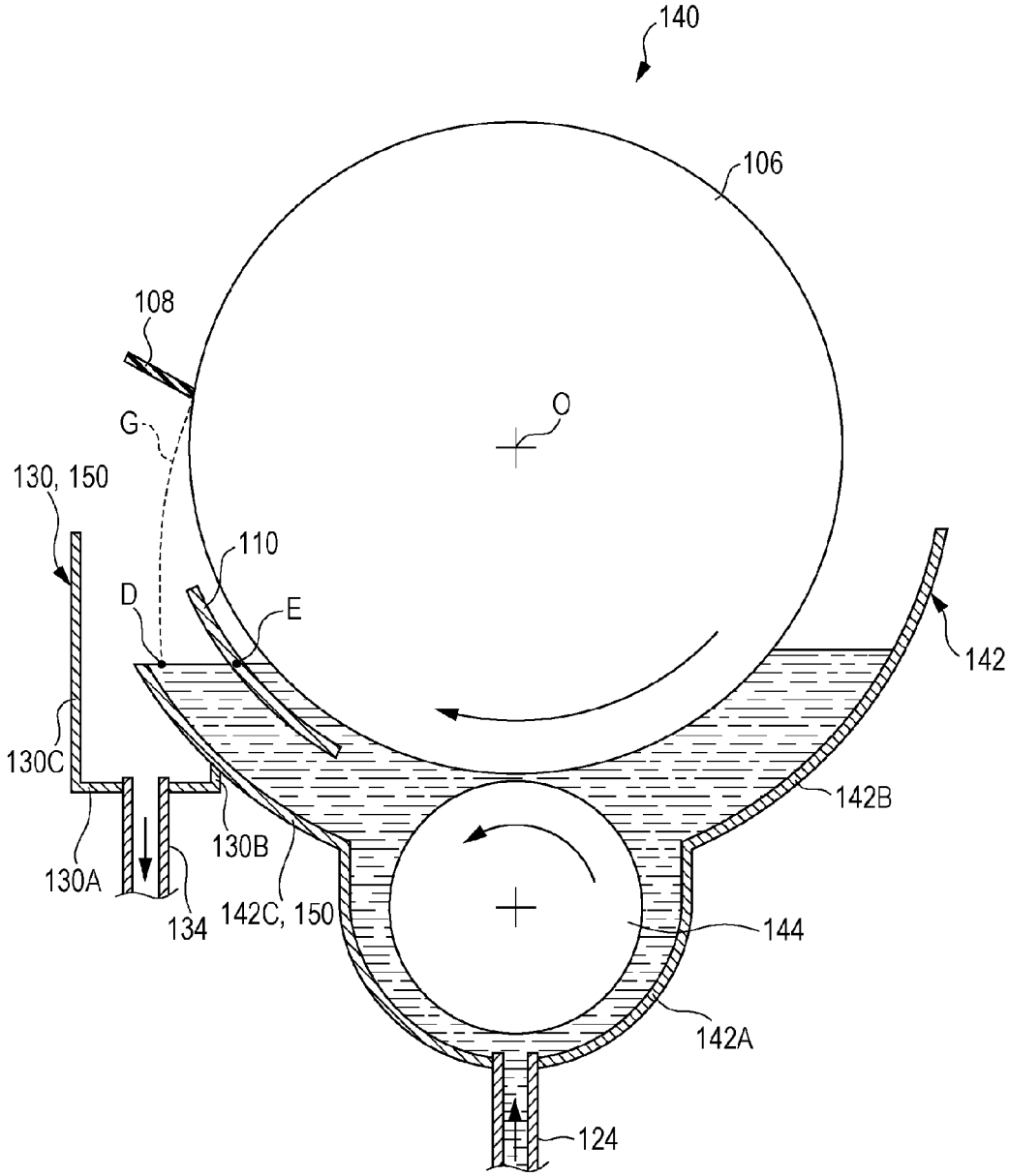
FIG. 6 is a schematic view illustrating a region surrounding a supply roller of a developing device according to the second exemplary embodiment of the present invention.

FIG. 6 illustrates a developing device 140, which is an example of an ink supply device, according to the second the exemplary embodiment. The developing device 140 includes a reservoir 142 and an auxiliary roller 144 instead of the reservoir 102 of the developing device 100 (see FIG. 2) according to the first exemplary embodiment. In other respects, the structure of the developing device 140 is the same as that of the developing device 100. The developing device 140 includes the developer supply portion 120 (see FIG. 2) and an overflow portion 150. The overflow portion 150, which is included in the reservoir 142, includes a second curved wall 142C (described below) that allows the liquid developer G to overflow. The overflow portion 150 further includes the receiving portion 130, which receives the liquid developer G that has flowed over the second curved wall 142C.

The reservoir 142 is, for example, a container extending in a longitudinal direction that is the same as the axial direction of the supply roller 106 and having a cross section taken along a plane intersecting the longitudinal direction that is open upward. To be specific, the reservoir 142 includes a lower wall 142A, a first curved wall 142B, and the second curved wall 142C. When the reservoir 142 is seen in the longitudinal direction, the lower wall 142A has a U-shaped cross section, the first curved wall 142B extends from one of the upper ends (the right upper end in FIG. 6) of the lower wall 142A in a diagonally upward direction, and the second curved wall 142C extends from the other upper end (the left upper end in FIG. 6) of the lower wall 142A in a diagonally upward direction.

The lower wall 142A is disposed between the rotation center O of the supply roller 106 and has a shape that is open toward the outer peripheral surface of the supply roller 106, and one end of the supply path 124 is connected to a bottom portion of the lower wall 142A.

The first curved wall 142B is a wall having an arc-shaped cross section extending diagonally rightward and upward in FIG. 6 from one of the upper ends of the lower wall 142A. The first curved wall 142B is disposed such that the distance between the first curved wall 142B and the outer peripheral surface of the supply roller 106 is substantially uniform along the circumferential direction of the supply roller 106.

The second curved wall 142C is a wall having an arc-shaped cross section extending diagonally leftward and upward (toward the receiving portion 130) in FIG. 6 from the other upper end of the lower wall 142A. The second curved wall 142C is disposed such that the distance between the second curved wall 142C and the outer peripheral surface of the supply roller 106 is substantially uniform along the circumferential direction of the supply roller 106. When the reservoir 142 is seen in the longitudinal direction, the upper end of the first curved wall 142B is higher than that of the second curved wall 142C. The liquid developer G is stored in the reservoir 142.

Moreover, for example, the aforementioned liquid surface detection sensor (not shown), which measures the amount of the remaining liquid developer G, is disposed in the reservoir 142. When the amount of the liquid developer G in the reservoir 142 decreases and become insufficient, the developer supply portion 120 (see FIG. 2) supplies new liquid developer G to the reservoir 142.

In addition, the receiving portion 130 is disposed outside of the second curved wall 142C of the reservoir 142. The upper end (the right upper end in FIG. 6) of the receiving portion 130 is attached to the lower surface of the second curved wall 142C. The blocking member 110 is disposed so as to extend from below to above the liquid surface of the liquid developer G at a position between the landing position D of the liquid developer G and the supply roller 106. The blocking member 110 faces the outer peripheral surface of the supply roller 106.

The leading end of the regulation blade 108 is in contact with the outer peripheral surface of the supply roller 106.

The auxiliary roller 144 is a cylindrical member that is rotatable by a driving unit (not shown) about an axis extending in a direction the same as the axial direction of the supply roller 106. The auxiliary roller 144 is disposed below the supply roller 106 so as to be surrounded by the lower wall 142A. At a position at which the auxiliary roller 144 faces the outer peripheral surface of the supply roller 106, the auxiliary roller 144 is separated from the outer peripheral surface of the supply roller 106 by a certain distance, and the auxiliary roller 144 moves (rotates) in the same direction as the supply roller 106 at the position. Moreover, there is a gap between the auxiliary roller 144 and the lower wall 142A.

Operation

Next, the operation of the second the exemplary embodiment will be described.

As illustrated in FIG. 6, a controller (not shown) of the developing device 140 activates the pump 126 (see FIG. 2), and the liquid developer G is supplied from the storage tank 122 (see FIG. 2) to the reservoir 142. Thus, the height of the liquid surface of the liquid developer G in the reservoir 142 reaches the height of the upper end of the second curved wall 142C.

Figure 7:
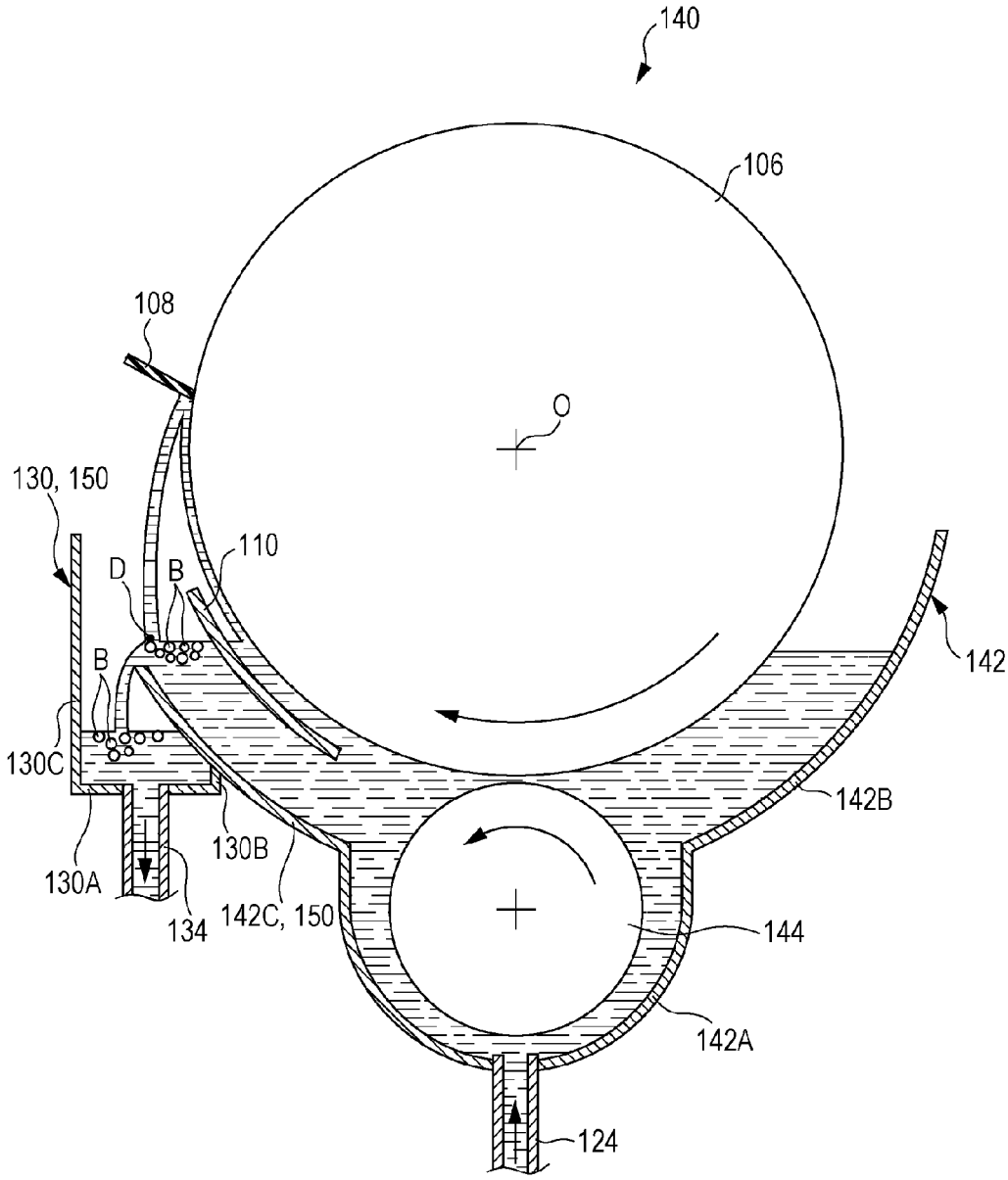
FIG. 7 is a schematic view illustrating a region surrounding the supply roller of the developing device according to the second exemplary embodiment of the present invention when bubbles are generated in the liquid developer near the supply roller.

Subsequently, as illustrated in FIG. 7, the supply roller 106 and the auxiliary roller 144 start rotating when an image forming operation starts. At this time, the liquid developer G that has flowed into a narrow flow path between the supply roller 106 and the auxiliary roller 144 is pressed in the narrow flow path, and thereby bubbles B are removed. Thus, bubbles B in the liquid developer G that passes through the space between the supply roller 106 and the auxiliary roller 144 and that is carried on the outer peripheral surface of the supply roller 106 are reduced. A part of the liquid developer G carried on the outer peripheral surface of the supply roller 106 passes the regulation blade 108 and is supplied to the development roller 104 (see FIG. 2), and the regulation blade 108 scrapes off the remaining part of the liquid developer G toward the reservoir 142.

Subsequently, as the liquid developer G that has been scraped off by the regulation blade 108 lands onto the liquid developer G in the reservoir 142, bubbles B and ripples (waves) of the liquid surface are generated at the landing position D. In FIG. 7, the ripples on the liquid surface are not illustrated.

With the developing device 140, the blocking member 110 blocks the movement of the bubbles B and the ripples on the liquid surface, which have been generated at the landing position D, before the bubbles B and the ripples reach the supply roller 106. Thus, the amount of bubbles B included in the developer G on the outer peripheral surface of the supply roller 106 is reduced and the ripples on the liquid surface are suppressed. As a result, generation of nonuniformity in the layer of the liquid developer G on the outer peripheral surface of the supply roller 106 is suppressed, and thereby nonuniformity in a developer image formed on the outer peripheral surface of the photoconductor 12 (see FIG. 1) is reduced.

With the developing device 140, the liquid surface of the liquid developer G rises when new liquid developer G is supplied by the developer supply portion 120 (see FIG. 2). Then, a surface portion of the liquid developer G at the landing position D and in the vicinity of landing position D flows over the upper end of the second curved wall 142C to the receiving portion 130. Because the bubbles B generated at the landing position D are present in the surface portion, the bubbles B are removed together with the liquid developer G that overflows to the receiving portion 130. Thus, the amount of bubbles in the surface portion of the liquid developer G adjacent to a position at which the supply roller 106 emerges from the liquid surface is reduced.

With the developing device 140, new liquid developer G is supplied from the deepest portion of the reservoir 142, which is located at a lower position, the new developer is not supplied to a position near the liquid surface of the liquid developer G. Thus, the amount of new liquid developer G that overflows to the receiving portion 130 before being supplied to the supply roller 106 is reduced.

Moreover, with the developing device 140, as the auxiliary roller 144 rotates, the liquid developer G that is located in a downstream part of the reservoir 142 in the rotation direction of the supply roller 106 is returned to an upstream part in the reservoir 142. Thus, the difference between the heights of the liquid surface on the downstream side of the auxiliary roller 144 and on the upstream side of the auxiliary roller 144 in the reservoir 142 is reduced.

Subsequently, as the pump 136 (see FIG. 2) is operated, the liquid developer G that has overflowed to the receiving portion 130 is recovered to the storage tank 122 (see FIG. 2).

The present invention is not limited to the exemplary embodiments described above.

The shape of the blocking member 110 is not limited to a curved shape. Instead, the blocking member 110 may have a flat plate-like shape.

The charger 105 in the exemplary embodiments is a corotron charger. Alternatively, the charger 105 may be a scorotron charger. As a further alternative, other known chargers, such as a needle electrode or a pin-array charger (charging unit) may be used.

The image forming apparatus 10 is not limited to an apparatus that forms an image on a recording sheet P by using a monochrome liquid developer G. The image forming apparatus 10 may be an apparatus that forms an image on a recording sheet P by using a liquid developers G having different colors. For example, the image forming apparatus 10 may include plural developing devices 100 or plural developing devices 140 that are arranged therein.

Moreover, the toner concentration sensor 132 is not limited to an optical sensor. For example, the toner concentration sensor 132 may measure the toner concentration in the liquid developer G by using decaying of a supersonic wave.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An ink supply device comprising:

a reservoir that stores ink;

an ink carrying rotary member that carries ink on an outer peripheral surface thereof;

a supply rotary member that is rotatable about a rotation axis that is parallel to a rotation axis of the ink carrying rotary member, the supply rotary member rotating and supplying the ink to the outer peripheral surface of the ink carrying rotary member while a part of the supply rotary member is immersed in the ink in the reservoir;

a regulation member that faces an outer peripheral surface of the supply rotary member, the regulation member regulating an amount of ink on the outer peripheral surface of the supply rotary member at a position outside of the reservoir; and a blocking member that extends from below to above a liquid surface of the ink in the reservoir during an operating state where the ink carrying rotary member carries ink, the blocking member extending above the liquid surface at a position between a landing position and the supply rotary member, the landing position being a position at which ink that has been scraped off by the regulation member lands on the liquid surface, the blocking member blocking movement of the ink in the reservoir from the landing position to the supply rotary member, wherein the blocking member extends along the rotation axis of the supply rotary member.

2. The ink supply device according to claim 1, further comprising:

an ink supply unit that supplies ink into the reservoir, and wherein the reservoir includes an overflow portion that allows ink to overflow from the ink reservoir outside of a wall of the reservoir, the wall being located opposite the supply rotary member with the landing position therebetween.

3. The ink supply device according to claim 2, wherein the overflow portion includes a receiving portion that receives the ink that has overflowed from the ink reservoir, the receiving portion being located outside of the wall.

4. An image forming apparatus comprising:

an image carrier that is rotatable, the image carrier carrying a latent image on an outer peripheral surface thereof;

the ink supply device according to claim 1, the ink supply device supplying ink on the ink carrying rotary member to the latent image on the image carrier to form a toner image, the ink including a carrier liquid and a toner dispersed in the carrier liquid; and a transfer unit that transfers the toner image on the image carrier to a recording medium.

* * * * *